US008177062B1

(12) United States Patent
Fruits

(10) Patent No.: US 8,177,062 B1
(45) Date of Patent: May 15, 2012

(54) PROTECTIVE CASE FOR RETRACTABLE MAGNIFIER OR DIGITAL MEDIA

(76) Inventor: Anne Hill Fruits, Tulsa, OK (US)

( * ) Notice: Subject to any disclaimer, the term of this patent is extended or adjusted under 35 U.S.C. 154(b) by 61 days.

(21) Appl. No.: 12/821,818

(22) Filed: Jun. 23, 2010

(51) Int. Cl.
*B65D 85/38* (2006.01)

(52) U.S. Cl. ..... 206/316.1; 206/759; 206/6; 206/751; 206/755

(58) Field of Classification Search ..... 206/316.1, 206/759, 6, 303, 445, 754, 751, 756, 755, 206/1.5; 359/802, 808, 817, 803, 804, 805, 359/813; 220/4.24, 4.25
See application file for complete search history.

(56) References Cited

U.S. PATENT DOCUMENTS

| | | | | | |
|---|---|---|---|---|---|
| 399,603 | A | * | 3/1889 | Domann | 206/755 |
| 416,552 | A | * | 12/1889 | Bique | 206/755 |
| 2,196,688 | A | * | 4/1940 | Warner et al. | 206/755 |
| 2,600,345 | A | * | 6/1952 | Venditti | 206/362.3 |
| 2,657,793 | A | * | 11/1953 | Goldshine | 206/755 |
| 3,353,657 | A | * | 11/1967 | Young | 206/755 |
| 3,904,035 | A | * | 9/1975 | Metzler et al. | 206/379 |
| 4,037,940 | A | | 7/1977 | Yates et al. | |
| 4,371,077 | A | * | 2/1983 | Solitt et al. | 206/759 |
| 4,681,216 | A | * | 7/1987 | Simkins | 206/755 |
| 4,782,942 | A | * | 11/1988 | Ashley et al. | 206/5.1 |
| 5,467,869 | A | * | 11/1995 | Elie et al. | 206/759 |
| 5,642,234 | A | | 6/1997 | Altman et al. | |
| 5,754,349 | A | | 5/1998 | Hon | |
| 5,979,661 | A | * | 11/1999 | Sherman et al. | 206/754 |

* cited by examiner

*Primary Examiner* — J. Gregory Pickett
*Assistant Examiner* — Andrew Perreault
(74) *Attorney, Agent, or Firm* — Head, Johnson & Kachigian, P.C.

(57) ABSTRACT

A protective case for a retractable item, such as a magnifier or digital media. The case is a hollow shell bisected from end to end to form two halves. At each end of each half there is a pivotal hinge. The hinges at one end join the halves mutually. The hinges at the other end support two arms separately. The two arms at their ends support the item mutually via a pivotal hinge. The case halves may be affected to remain apart by a spring and to remain joined by a releasable hook. To use the item, the halves are parted, the arms extend the item, and the halves are re-joined. To protect the item, the halves are parted, the arms retract the item, and the halves are re-joined.

14 Claims, 3 Drawing Sheets

PROTECTIVE CASE FOR RETRACTABLE MAGNIFIER OR DIGITAL MEDIA

BACKGROUND OF THE INVENTION

1. Field of the Invention

This invention relates generally to a protective case for a retractable magnifier or digital media, and more particularly to a protective case that is attached to and can be used alternately to store or support an item, such as a magnifier or digital media.

2. Description of the Related Art

Hand held magnifiers of low power have been used for centuries to improve the eye's ability to see small objects. Light reflected from a surface is gathered by a convergent lens and refracted upon the lens surface. Enhancement of detail is useful to naturalists, printers, collectors, and appraisers.

Lenses are readily available in powers between 2 and 9 and formed from glass or plastic. This lens is typically held quite close to the eye (at 2.5 cm.) while the viewed object is held about 10 cm away from the lens. The lens diameter is typically about 30 mm.

To offer protection for the lens against dirt and abrasion, cases have been devised. The more useful ones keep the lens attached to the case and thus are always at hand after viewing. Some lenses are mounted on a pin and pivot out of the case when used, as in Altman et al., U.S. Pat. No. 5,642,234. Some lenses are mounted on a frame and slide out of the case when used, as in Hon, U.S. Pat. No. 5,754,349. However, prior art cases are frequently unwieldy and embody a light source, which adds complexity and a possibility of failure. In prior art the close proximity of the case to the lens during use has caused a shadow to be cast upon the viewed object by the lens support and by the hand holding it. Furthermore, when the magnifier is worn as a pendent, the necklace on which the magnifier is worn must be quite long to allow for manipulation of the magnifier. Additionally, opening and closing prior art cases may be difficult for users with limited dexterity or weak hands.

Digital media, including flash drives and memory cards, are commonly used to store and transport data. It has become increasingly common for individuals to carry digital media with them, whether on a keychain, in a purse, in a pocket, or in a bag. However, digital media carried in such a manner is generally unprotected and vulnerable to damage.

Based on the foregoing, it is desirable to provide a simple, novel protective case for a magnifier lens or digital media. It is further desirable for the case to be attached to the lens or digital media so that the case is not easily lost while the lens or digital media is in use. It is further desirable for the case to serve as a handle for the lens or digital media when the lens or digital media is in use. It is further desirable for the case to be easy to open and close for users with limited dexterity or weak hands. It is further desirable for the case to present little interference to incident light and allow the hand to stay well out of the way.

SUMMARY OF THE INVENTION

In general, the invention relates to a protective case for a retractable item. The case has a top, a bottom, a first end, and a second end, where the case is a hollow shell bisected to form a first case half and a second case half, where the first case half and the second case half each have an interior side along which the first case half and the second case half meet, and where the case is in a closed position when the interior side of the first case half abuts the interior side of the second case half. A case hinge connects the first case half to the second case half at the first end of the case such that the first case half and the second case half may pivot relative to each other between the closed position and an open position. The protective case for a retractable item further comprises an item to be protected by the case and at least two arms connecting the item to the second end of the case, where one arm connects the item to the second end of the first case half and one arm connects the item to the second end of the second case half, and where the at least two arms are pivotally connected to the item and pivotally connected to the case. The item, the arms, and the case are sufficiently sized and positioned such that: the first case half and the second case half may be pivoted relative to each other and the arms may be pivoted relative to the item and to the case such that the first case half and the second case half may be brought into the open position, the item may be retraced into the case, the first case half and the second case half may be brought into the closed position, and the item and the arms may fit within the case while the case is in the closed position; and the first case half and the second case half may be pivoted relative to each other and the arms may be pivoted relative to the item and to the case such the first case half and the second case half may be brought into the open position, the item and the arms may be extended from the case, and the first case half and the second case half may be brought into the closed position.

The case hinge may be a spring hinge tending to maintain the case in the open position. The protective case may further comprise a hook mantel attached to the top of the first case half, a hook anchored to the hook mantel, and an eye mantel attached to the top of the second case half, where the eye mantel has a perforated slot capable of receiving the hook, such that connecting the hook to the eye mantel secures the case in the closed position. The protective case may further comprise a hook mantel attached to the bottom of the second case half, a hook anchored to the hook mantel, and an eye mantel attached to the bottom of the first case half, where the eye mantel has a perforated slot capable of receiving the hook, such that connecting the hook to the eye mantel secures the case in the closed position. The hook may be connected to the eye mantel by squeezing the first case half and the second case half together, and the hook may be disconnected from the eye mantel by depressing the center of the hook. The case may further comprise an indentation in the top of the second case half and likewise in the bottom of the first case half forming a hook guide along which the hook may travel as it approaches the perforated slot in the eye mantel.

The item to be protected by the case may be a magnifying lens. The protective case may further comprise a lens mount, where the lens mount girdles the lens, and a tensioner, where the lens mount is secured to the lens via the tensioner. The lens mount may be a band of flat spring metal or other flexible material of sufficient length to nearly encircle the lens. The tensioner may be adjustable to allow a user to replace the lens with a different lens. The tensioner may be pivotally connected to the at least two arms via at least two lens mount hinges. Alternately, the lens may be pivotally connected directly to the at least two arms via at least two lens mount hinges. The at least two arms may be formed of flat spring metal. The at least two arms may be capable of lying flat against and nearly surrounding the lens when the lens is retracted into the case and the case is in the closed position. The at least two arms may also be capable of supporting the lens as cantilevers when the lens is extended from the case and the case is in the closed position.

The item to be protected by the case may be an item of digital media. If so, the at least two arms may be rigid, and the protective case may further comprise a mount into which the digital media is mounted, where the mount is pivotally connected to the at least two arms via at least two mount hinges.

Other advantages and features will be apparent from the following description, and from the claims.

DETAILED DESCRIPTION OF THE INVENTION

The devices discussed herein are merely illustrative of specific manners in which to make and use this invention and are not to be interpreted as limiting in scope.

While the devices have been described with a certain degree of particularity, it is to be noted that many modifications may be made in the construction and the arrangement of the structural and functional details disclosed herein without departing from the spirit and scope of this disclosure. It is understood that the devices are not limited to the embodiments set forth herein for purposes of exemplification.

Figure 1:
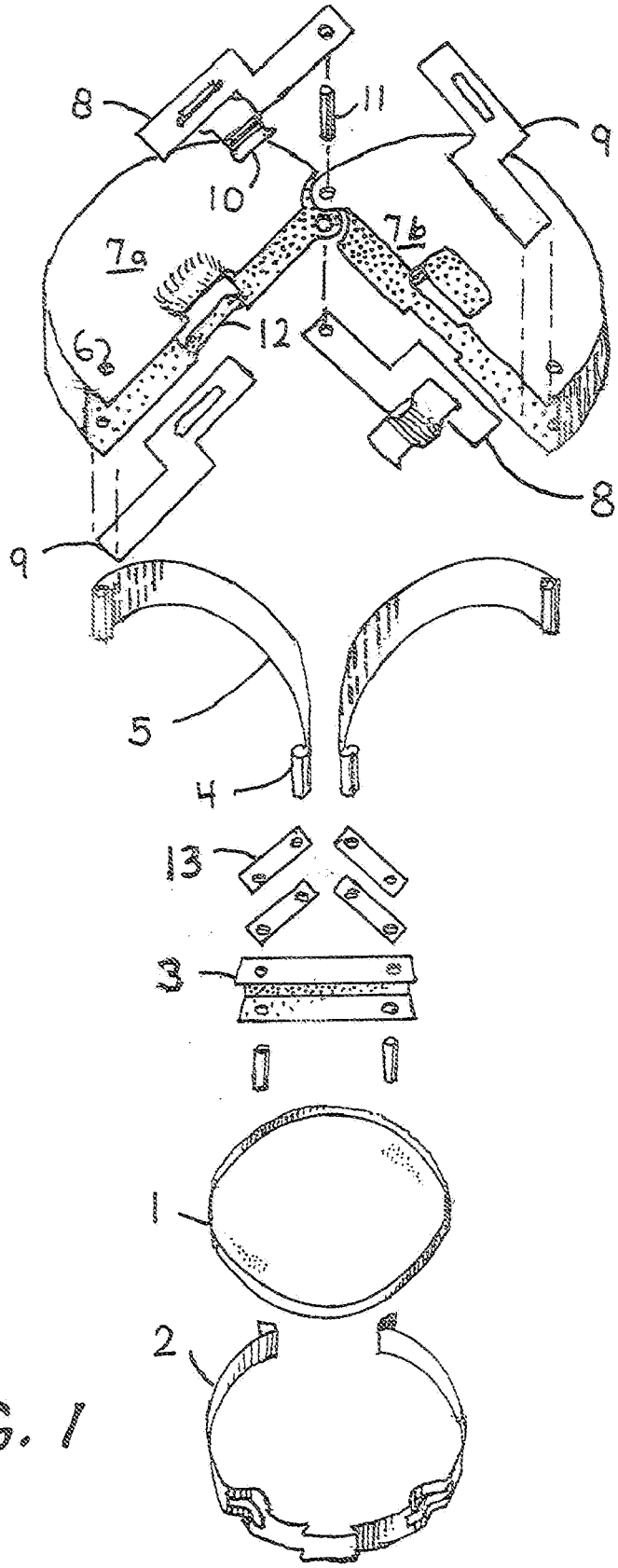
FIG. 1 is an exploded view of an illustrative embodiment of the protective case for retractable magnifier.

Referring to the figures of the drawings, wherein like numerals of reference designate like elements throughout the several views, and initially to FIG. 1, an optical element or lens 1 is attached to and capable of being stored in a case 7. The lens 1 is mounted to its case 7 by a pair of flat spring arms 5. The arms 5 support the lens 1 when the lens 1 is in use, in a cantilevered way, at some distance from the case 7. When not in use, the lens 1 is enfolded by the arms 5 and retracted into the case 7, which itself is hinged. The arms 5 tend to resist closure of the sides of case 7. By manually overcoming this resistance, a hook 10 mounted on the case 7 is engaged to keep the sides of the case 7 in contact. Integral to the hook 10 may be a release button which, when depressed, allows the sides of the case 7 to spring apart and the arms 5 to move the lens 1 in its planar path.

When the lens 1 is in use, the arms 5 are fully extended and the case 7 is latched. To retract the lens 1, the hook 10 is depressed and the sides of the case 7 spring apart. By tilting the device, gravity assists the arms 5 to surround the lens 1 and fold into the case 7. A squeeze engages the hook 10 and the lens 1 is prepared for transport in a purse, a pocket, or on a pendant.

To extend the lens 1, the hook 10 is depressed allowing the sides or the case 7 to spring apart. By holding the case 7 loosely, the lens 1 drops from case 7 as the hinged arms 5 unfold. The user brings the sides of the case 7 together, which fully extends the cantilevered arms 5. Resistance is met as the case 7 is closed but now it is because the arms 5 are meeting and being straightened. A squeeze engages the case hook 10 and the lens 1 is fixed at full extension and ready to use. The case 7 provides a hand hold.

The protective case for retractable magnifier may comprise a lens assembly and a case assembly. The lens assembly may comprise an optical element or lens 1, a lens mount 2, a tensioner 3, at least one lens mount hinge 4, and at least one arm 5. The lens 1 may be made of glass or plastic and may provide magnification of appropriate power (2× to 9×) for general use. The lens 1 may have a diameter of about 30 mm.

The lens 1 may be girdled by lens mount 2, which may be a band of flat spring metal or other sufficiently flexible material of sufficient length to nearly encircle the lens 1. The lens mount 2 may be secured to the lens 1 via the tensioner 3. The tensioner 3 may be made of rigid material and may be formed to receive and join the two ends of the lens mount 2. The tensioner 3 may be adjustable to allow the user to replace the lens 1 with one with a different power or diameter.

The tensioner 3 may also function to attach the lens 1 to the at least one arm 5 via the at least one lens mount hinge 4. The at least one lens mount hinge 4 may be a simple pivot (pin-and-knuckle) hinge whose axis of rotation parallels the optical axis. The hinge 4 itself may be transient—it moves from one position to another based upon the phase of case 7 (open/closed/in transition). The lens mount hinge 4 may be placed on a hinge link 13, which acts like a cam. This variable offset improves freedom of lens 1 movement into and out of the case 7.

Alternately, the lens assembly may omit the lens mount 2 and tensioner 3, and the lens 1 may be attached directly to the arms 5 via the lens mount hinges 4. However, this alternative would make changing the lens more difficult.

Preferably, the lens assembly includes two arms 5 and two lens mount hinges 4, one for each arm 5. The arms 5 may be paired and opposing. The arms 5 may be formed of flat spring and may be jointed to the lens mount 2 pivotally, as via the lens mount hinges 4. The arms 5 may lie flat against and nearly surround the lens mount 2 when the lens 1 is in the case 7, yet the arc of the arms 5 may differ from that of the lens mount 2 as the arms 5 describe a greater radius. The arms 5 may be formed specially to spring against further curving or straightening and to perform as cantilevers by rigidly resisting the sag of gravity.

In the same way that the arms 5 join the lens mount 2 at one end via the lens mount hinges 4, the arms 5 join the case 7 at their other end via arm hinges 6. The arms 5 swing freely in a radial arc yet resist deviation therefrom.

The case assembly generally comprises the case 7, which is bisected into case halves 7*a* and 7*b*, a case hinge 11, a hook mantel 8, an eye mantel 9, a hook 10, and a hook guide 12. The case 7 may be hollow, allowing an interior cavity into which the lens 1 may fit. The case 7 may be made of rigid material to protect the lens 1 when the lens 1 is stored within the case 7. The case 7 may have a curved perimeter, such that the case has a generally circular or oval lateral cross section. The case 7 may generally be described as a hollow elongated or oval disc. The case 7 may be generally bisected along its long axis into case halves 7*a* and 7*b*, such that case halves 7*a* and 7*b* are generally symmetrical.

This symmetry may have one exception: on the top side of the case, just before reaching a first end of the case 7, the bisecting line may deviate in a short arc or semi-circle. This forms a curved tab on the top side of case half 7*b*. The bisecting line may similarly deviate near the first end on the bottom side of the case 7, but in the opposite direction, forming a curved tab on the bottom side of case 7*a*. The case halves 7*a* and 7*b* are thus rotationally symmetrical such that, when one case half is rotated along the case's line of bisection, it is identical to the other case half. This rotational symmetry rules all functions of the disclosed device and simplifies discussion so that one mention describes two instances.

Both the top and the bottom of the case may have a hook mantel 8 and an eye mantel 9. The mantels 8 and 9 provide a locus of attachment or support. A hook mantel 8 may be attached to the top of case half 7*a* and an eye mantel 9 may be attached to the top of case half 7*b*. Likewise, in accordance with the rotational symmetry described above, a hook mantel 8 may be attached to the bottom of case half 7*b* and an eye mantel 9 may be attached to the bottom of case half 7*a*. Each hook mantel 8 extends from the center of the case half to which it is attached (i.e., the top of case half 7*a* and the bottom of case half 7*b*) to the first end of the case 7. Each hook mantel 8 includes a projection that projects past the edge of the case half such that the projection overlaps the edge of the other case half. Likewise, each eye mantel 9 extends from the center of the case half to which it is attached (i.e., the bottom of case half 7*a* and the top of case half 7*b*) to the second end of case 7, where the second end of case 7 is opposite the first end of case 7. Each eye mantel 9 includes a projection that projects past the edge of the case half such that the projection overlaps the edge of the other case half. The hook mantels 8 and eye mantels 9 are spaced such that their respective projections overlap only the opposite case half and not the opposite mantel. Thus, the hook mantels 8 and eye mantels 9 each may be doglegged.

As noted above, a curved tab may be located on the top of case half 7*b* adjacent the first end of case 7 and a curved tab may be located on the bottom of case half 7*a* adjacent the first end of case 7. Each of these tabs may act as a hub through which a pivot pin or axel may pass. The pivot pin or axel may also pass through the projection in the hook mantel 8 located on the opposite half of the case, such that the tab on the top of case half 7*b* may be adjoined to the projection of the hook mantel 8 attached to the top of case half 7*a*, and the tab on the bottom of case half 7*a* may be adjoined to the projection of the hook mantel 8 attached to the bottom of case half 7*b*, thus forming case hinge 11.

The case hinge 11 may connect the two case halves 7*a* and 7*b* to each other at the first end of the case 7, allowing the case 7 to be opened and closed similar to a ladybug's wing covers, as viewed from above. The case hinge 11 may be a simple hinge offering no assistance to opening of the case 7, or the case hinge 11 may be a spring hinge tending to maintain the case 7 in an open position. The case hinge 11 may be located at the opposite end of the case 7 from the arm hinges 6 by which the arms 5 are attached to the case halves 7*a* and 7*b*. Thus, if the case hinge 11 is located at the first end of the case 7, the arm hinges 6 are located at the second ends of case halves 7*a* and 7*b*.

The hook mantel 8 may serve two purposes: it provides the projection that is part of case hinge 11 and it anchors the closing mechanism for the case. This second function is served by the portion of the hook mantel 8 that does not project over the edge of the case half to which it is attached, located towards the center of the case half. In this portion of the hook mantel 8 may be a perforated slot parallel to the long axis of the case 7 of sufficient size to accommodate a hook 10, discussed below. The eye mantel 9 on the opposite half of the case 7 also may have a perforated slot parallel to the long axis of the case 7. The perforated slot on the eye mantel 9 may line up with the perforated slot on the hook mantel 8. The case 7 may likewise have a hole beneath the perforated slot of each eye mantel 9 to allow the eye mantel to receive the hook 10, discussed below.

The hook 10 may join the case halves 7*a* and 7*b* together. The case assembly may include two hooks 10, one on the top of the case 7 and one on the bottom of the case 7. As noted above, if the case hinge 11 is a spring hinge, the case 7 tends to an open position. Likewise, the "spring" of the arms 5 exert pressure outward on the case halves 7*a* and 7*h* whenever the lens 1 nears full extension and also whenever the lens 1 nears full retraction.

The hook 10 may be formed from a short length of flat spring metal, similar to the lens mount 2 and arms 5. The hook 10 may be permanently formed with hooks at both ends and a rise in middle, such that, from its side, the hook 10 resembles the cross-profile of a wide brimmed hat: the furthest points of the brim curve upward as hooks.

The hook 10 may be placed transversely and anchored permanently at the slot in the hook mantel 8. The case 7 beneath the hook mantel 8 may be indented to allow the hook 10 to lie between the hook mantel 8 and the case 7 where all three layers may be tightly fused. Anchoring may be assured by allowing the end of the hook 10 to rise through the slot in the hook mantel 8.

The hook 10 may span the border between case halves 7*a* and 7*b*. One side may be fixed to the hook mantel 8 and the other side may reach and line up with the slot in the corresponding eye mantel 9. To operate, the case halves 7*a* and 7*b* are brought together manually with a slight squeeze of the hand. The exposed end of the hook 10 aligns with the slot in the eye mantel 9 and is slightly deformed as it is pushed towards the slot. Once the hook reaches the slot, it returns to its former shape and remains there under the constant tension from the arms 5 and/or case hinge 11 (if the case hinge 11 is a spring hinge). To open the case, the user depresses the hook 10 where it is exposed. This separates the hook 10 from the eye mantel 9 and the arms 5 and/or case hinge 11 forces the case halves 7*a* and 7*b* apart.

The case 7 may be indented near the slot in the eye mantel 9, forming a hook guide 12. The hook guide 12 helps to align the hook 10 in its path toward the slot in the eye mantel 9.

To use the lens 1, the hook 10 is depressed allowing the case sides 7*a* and 7*b* to spring apart. The lens 1 drops from the case as the hinged arms 5 unfold. The case sides 7*a* and 7*b* are brought together manually to fully extend the cantilevered arms 5. Again, the resistance is met as the case 7 is closed due to either spring hinge or because the arms 5 are being straightened. A squeeze engages the hook 10 and the lens 1 is fixed at full extension and ready to use. The case 7 provides the hand hold.

The protective case for retractable magnifier disclosed herein offers several improvements over the prior art. The case 7 improves the usefulness of the lens 1, as the case 7 is simpler and easier to use than previously known protective cases. The case 7 protects the lens 1 and functions as a handle for the lens 1. The arms 5 allow for a greater reach of the lens 1 from the case 7, which is of particular utility when the case 7 is worn as a pendant. When previously known cases were worn as a pendant, the necklace on which the case was worn was required to be quite long to allow for manipulation of the attached lens. The present invention's arms 5 add about two lens widths to the pendant and permit a normal chain to be worn. Additionally, the additional extension of the lens allows for increased light incident upon the object viewed. The case 7 pops open with a simple squeeze of the hand. With the aging population it is more important than ever to accommodate limited dexterity and weaker hands. By pressing the sides of the case 7 together, with the lens 1 extended or retracted, the case 7 is locked closed. Thus, the extended lens 1 may be passed from one person to another by the handle (i.e., the case 7), and there is no danger of touching the lens 1 inadvertently as with prior art pin mounted lenses. The lens 1 may be replaced with a new one or one of a different power by the user with an eyeglass repair kit.

The case 7 itself can lend itself to other uses where quick enablement of a passive panel is required. Anticipated is frequent usage in the future of integrated chips like today's memory cards which the user will insert into or swipe through a drive or reader. Such a case may be made of a shielded material to protect against electro-magnetic frequency disruptions.

Figure 2:
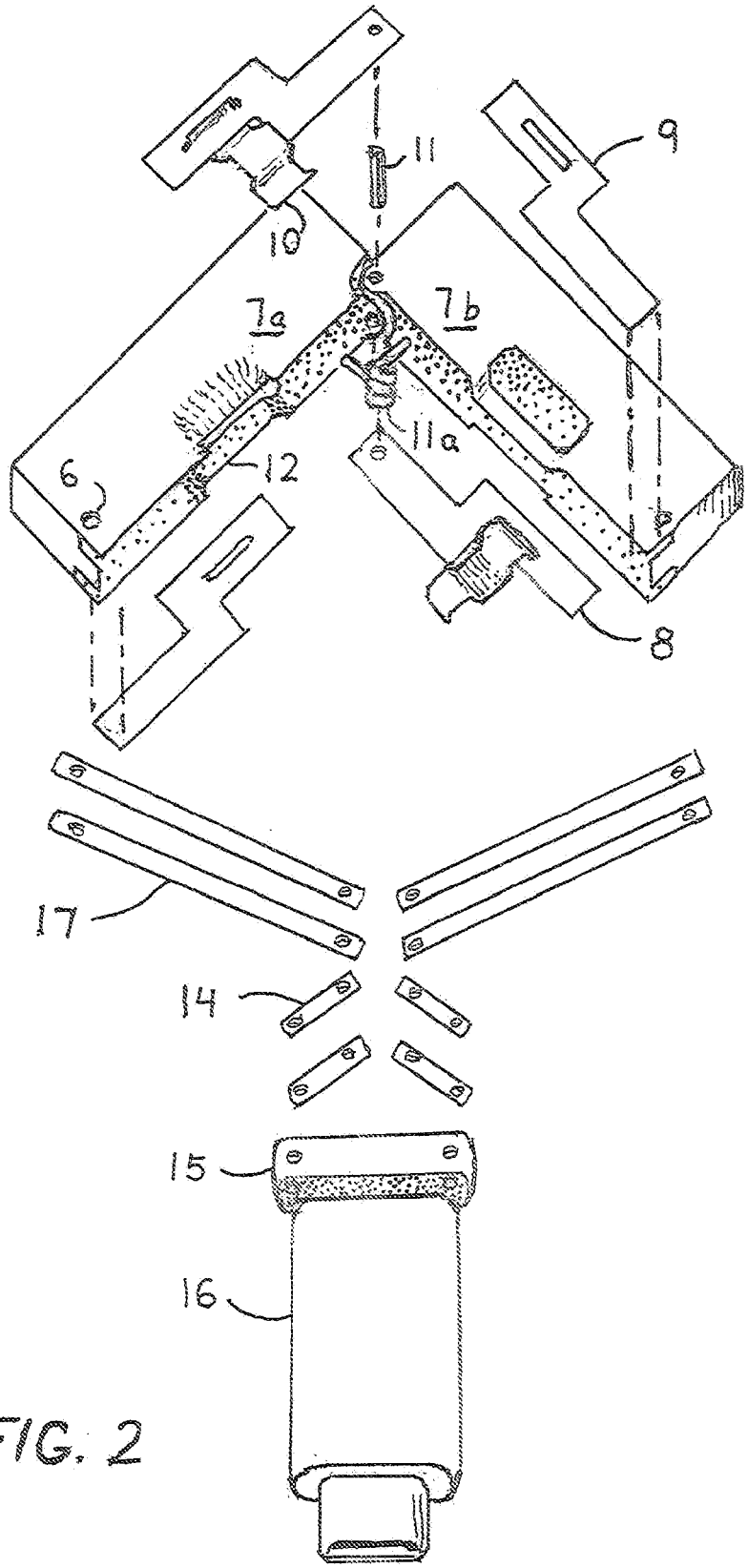
FIG. 2 is and exploded view of an illustrative embodiment of the protective case for digital media.
Figure 3:
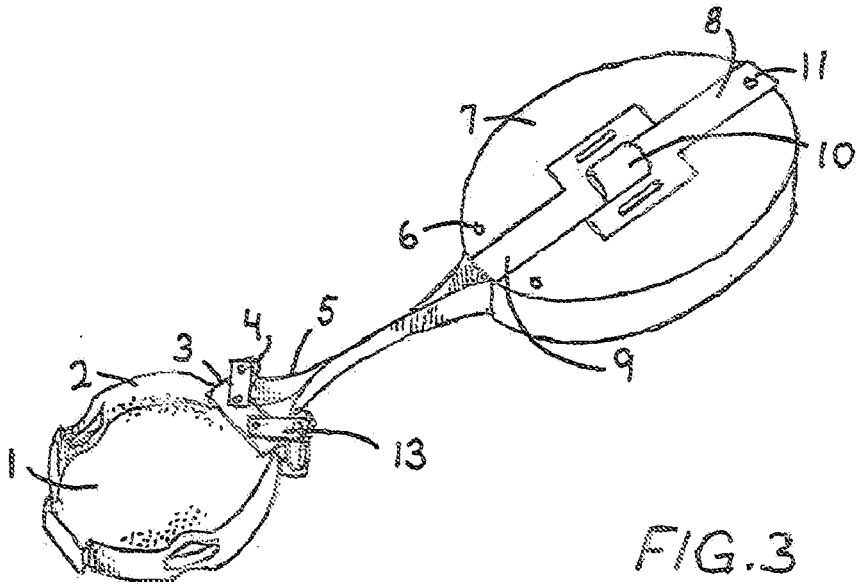
FIG. 3 is a perspective view of an illustrated embodiment of the protective case for retractable magnifier (ready to use) in an extended position.
Figure 4:
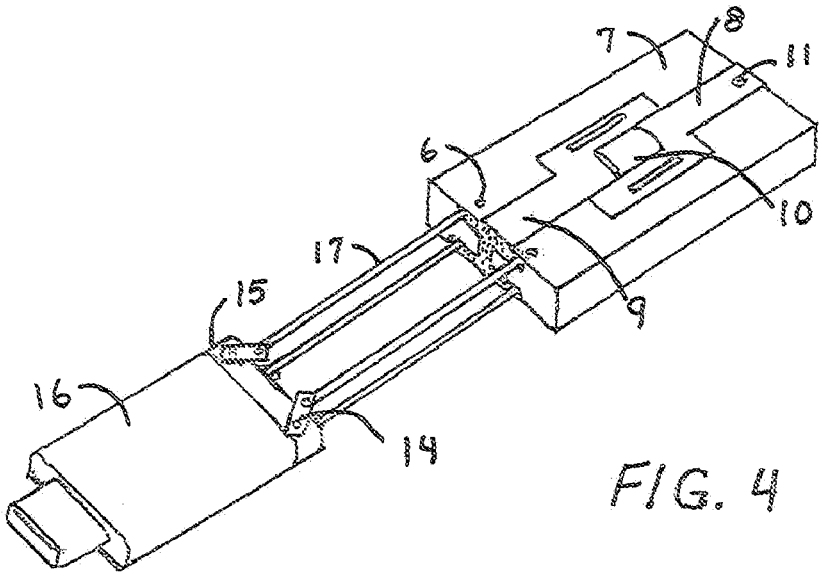
FIG. 4 is a perspective view of an illustrative embodiment of the protective case for digital media (ready to use) in an extended position.

When the case 7 is used with digital media or any other non-circular item, the case 7 may have certain variations, as shown in FIG. 2. For example, case 7 may be rectangular or another shape. The case 7 may still be bisected into case halves 7*a* and 7*b*. The case halves 7*a* and 7*b* may still be connected via a case hinge 11, which may be a simple hinge or a spring hinge 11*a*, as shown. The arms 17 holding the digital media 16 may be rigid rather than springy, but they may still be connected to the case via arm hinges 6. The digital media 16 may be mounted in a mount 15, which may be connected to the arms 17 via mount hinges 14. The ease 7 may be used in the same way as described above.

Whereas, the devices have been described in relation to the drawings and claims, it should be understood that other and further modifications, apart from those shown or suggested herein, may be made within the spirit and scope of this invention.

What is claimed is:

1. A protective case for a retractable item, the protective case comprising:

a case with a top, a bottom, a first end, and a second end, where the case is a hollow shell bisected to form a first case half and a second case half, where the first case half and the second case half each have an interior side along which the first case half and the second case half meet, and where the case is in a closed position when the interior side of the first case half abuts the interior side of the second case half;

a case hinge connecting the first case half to the second case half at the first end of the case such that the first case half and the second case half may pivot relative to each other between the closed position and an open position;

an item to be protected by the case, where the item to be protected by the case is a magnifying lens;

a lens mount, where the lens mount girdles the lens;

a tensioner, where the lens mount is secured to the lens via the tensioner; and at least two arms connecting the item to the second end of the case, where one arm connects the item to the second end of the first case half and one arm connects the item to the second end of the second case half, where the at least two arms are pivotally connected to the item and pivotally connected to the case, and where the tensioner is pivotally connected to the at least two arms via at least two lens mount hinges;

where the item, the arms, and the case are sufficiently sized and positioned such that:

the first case half and the second case half may be pivoted relative to each other and the arms may be pivoted relative to the item and to the case such that the first case half and the second case half may be brought into the open position, the item may be retracted into the case, the first case half and the second case half may be brought into the closed position, and the item and the arms may fit within the case while the case is in the closed position; and the first case half and the second case half may be pivoted relative to each other and the arms may be pivoted relative to the item and to the case such the first case half and the second case half may be brought into the open position, the item and the arms may be extended from the case, and the first case half and the second case half may be brought into the closed position.

2. The protective case for a retractable item of claim 1 where the case hinge is a spring hinge tending to maintain the case in the open position.

3. The protective case for a retractable item of claim 1, further comprising:

a hook mantel attached to the top of the first case half;

a hook anchored to the hook mantel; and an eye mantel attached to the top of the second case half, where the eye mantel has a perforated slot capable of receiving the hook, such that connecting the hook to the eye mantel secures the case in the closed position.

4. The protective case for a retractable item of claim 3, further comprising:

a hook mantel attached to the bottom of the second case half;

a hook anchored to the hook mantel; and an eye mantel attached to the bottom of the first case half, where the eye mantel has a perforated slot capable of receiving the hook, such that connecting the hook to the eye mantel secures the case in the closed position.

5. The protective case for a retractable item of claim 3 where the hook may be connected to the eye mantel by squeezing the first case half and the second case half together.

6. The protective case for a retractable item of claim 3 where the hook has a center and where the hook may be disconnected from the eye mantel by depressing the center of the hook.

7. The protective case for a retractable item of claim 3, further comprising an indentation in the top of the second case half, an indentation in the bottom of the first case half, or both an indentation in the top of the second case half and an indentation in the bottom of the first case half, forming a hook guide along which the hook may travel as it approaches the perforated slot in the eye mantel.

8. The protective case for a retractable item of claim 1 where the at least two arms are capable of swinging freely in a radial arc yet resist deviation therefrom.

9. The protective case for a retractable item of claim 1 where the lens mount is a band of flat spring metal or other flexible material of sufficient length to nearly encircle the lens.

10. The protective case for a retractable item of claim 1 where the tensioner is adjustable to allow a user to replace the lens with a different lens.

11. The protective case for a retractable item of claim 1 where the lens is pivotally connected to the at least two arms via at least two lens mount hinges.

12. The protective case for a retractable item of claim 1 where the at least two arms are formed of flat spring metal.

13. The protective case for a retractable item of claim 1 where the at least two arms are capable of lying flat against and nearly surrounding the lens when the lens is retracted into the case and the case is in the closed position.

14. The protective case for a retractable item of claim 1 where the at least two arms are capable of supporting the lens as cantilevers when the lens is extended from the case and the case is in the closed position.

* * * * *